United States Patent [19]

Suzuki et al.

[11] Patent Number: 5,007,506

[45] Date of Patent: Apr. 16, 1991

[54] ELEVATOR REMOTE-CONTROL METHOD

[75] Inventors: Shigehiko Suzuki; Kenzo Tachino, both of Inazawa, Japan

[73] Assignee: Mitsubishi Denki Kabushiki Kaisha, Japan

[21] Appl. No.: 496,222

[22] Filed: Mar. 20, 1990

[30] Foreign Application Priority Data

May 18, 1989 [JP] Japan ..... 1-122789

[51] Int. Cl.[5] ..... B66B 3/00

[52] U.S. Cl. ..... 187/101; 187/130; 187/133

[58] Field of Search ..... 187/101, 130, 133; 364/937; 340/502, 503, 504, 825.34; 379/106, 107, 102, 104

[56] References Cited

U.S. PATENT DOCUMENTS 4,095,050 6/1978 Beachem et al. ..... 379/105
4,697,243 9/1987 Moore et al. ..... 187/133

FOREIGN PATENT DOCUMENTS 63-258382 10/1988 Japan .

*Primary Examiner*—A. D. Pellinen
*Assistant Examiner*—Charles E. Eckholdt
*Attorney, Agent, or Firm*—Leydig, Voit & Mayer

[57] ABSTRACT

An elevator remote-control method according to this invention consists in that, when a maintenance command has been received, a call-back program is executed which comprises a ring-off processing step of once disconnecting a telephone circuit, and a reconnection step of dialing a remote monitoring center to reconnect the telephone circuit, whereupon a program which conforms to the maintenance command is executed.

4 Claims, 5 Drawing Sheets

ELEVATOR REMOTE-CONTROL METHOD

BACKGROUND OF THE INVENTION

This invention relates to an elevator remote-control method wherein a program or data within an elevator control circuit is changed from a remote monitoring center by the use of a telephone circuit. More particularly, it relates to an elevator remote-control method which hinders a third party from intervening, thereby to attain an enhanced reliability.

FIG. 4 is a block diagram showing a conventional elevator control system which is described in, for example, the official gazette of Japanese Patent Application Laid-open No. 258382/1988. Referring to the figure, the elevator control system includes an elevator 1, an elevator control circuit 2 which drives and controls the elevator 1 in response to a hall call and a cage call, a remote monitoring center 3 which monitors the service state of the elevator 1, and a telephone circuit 4 which connects the elevator control circuit 2 and the remote monitoring center 3.

The elevator control circuit 2 is configured of a CPU 21, and a memory 22, an elevator interface 23 and a communication interface 24 which are respectively connected to the CPU 21 through a bus B. The elevator interface 23 is connected to the elevator 1, while the communication interface 24 is connected to the telephone circuit 4. On the other hand, the remote monitoring center 3 is configured of a computer 31, and a keyboard 32, a CRT 33 and a communication interface 34 which are respectively connected to the computer 31. The communication interface 34 is connected to the telephone circuit 4.

Now, an elevator remote-control method in the prior art will be described with reference to a flow chart in FIG. 5. By the way, control operations in FIG. 5 are executed by the CPU 21 which is included in the elevator control circuit 2.

First, for the purpose of causing the elevator control circuit 2 to run a maintenance control program, an operator in the remote monitoring center 3 inputs a maintenance command along with a secret code (key code) from the keyboard 32. On this occasion, the maintenance command contains various commands which express maintenance start, maintenance end, memory display, memory correction, etc. The key code is input only when the maintenance start command is input.

When the maintenance command is input to the elevator control circuit 2 through the telephone circuit 4, the CPU 21 ceases the run of an elevator control program and decodes the input command as interrupt processing (step S0).

If the decoded command is the maintenance start command, the CPU 21 decides whether or not the key code simultaneously input agrees with a key code previously set for the elevator control circuit 2 (step S1). Only when the key codes are in agreement, the CPU 21 runs a maintenance start program (step S2).

On the other hand, if the decoded input command is the maintenance end command, memory display command or memory correction command, the CPU 21 runs a maintenance end program (step S3), memory display program (step S4) or memory correction program (step S5), respectively.

With the elevator remote-control method in the prior art, as stated above, the maintenance control program is run if the key code which is input with the maintenance start command agrees. Therefore, the prior-art method has had the problem that, when the maintenance command and the key code have been known, a third party can refer to and change the programs or data held in the elevator control circuit 2, so the normal elevator control is hampered.

SUMMARY OF THE INVENTION

This invention has been made in order to solve the problem as mentioned above, and has for its object to provide an elevator remote-control method which can hinder a third party from intervening in the maintenance control of an elevator without spoiling the function of the maintenance control from a remote monitoring center.

The elevator remote-control method according to this invention consists in that, when a maintenance command has been received, a call-back program is run which comprises the ring-off processing step of once disconnecting a telephone circuit, and the reconnection step of dialing a remote monitoring center to reconnect the telephone circuit, whereupon a program which conforms to the maintenance command is run.

In this invention, even when a maintenance command from a third party has been input, an elevator control circuit is once rung off and is thereafter reconnected to the remote monitoring center, so that the maintenance control program is not run in conformity with the command from the third party.

BRIEF DESCRIPTION OF THE DRAWINGS

Throughout the drawings, the same symbols indicate identical or equivalent portions.

DESCRIPTION OF THE PREFERRED EMBODIMENTS

Figure 1:
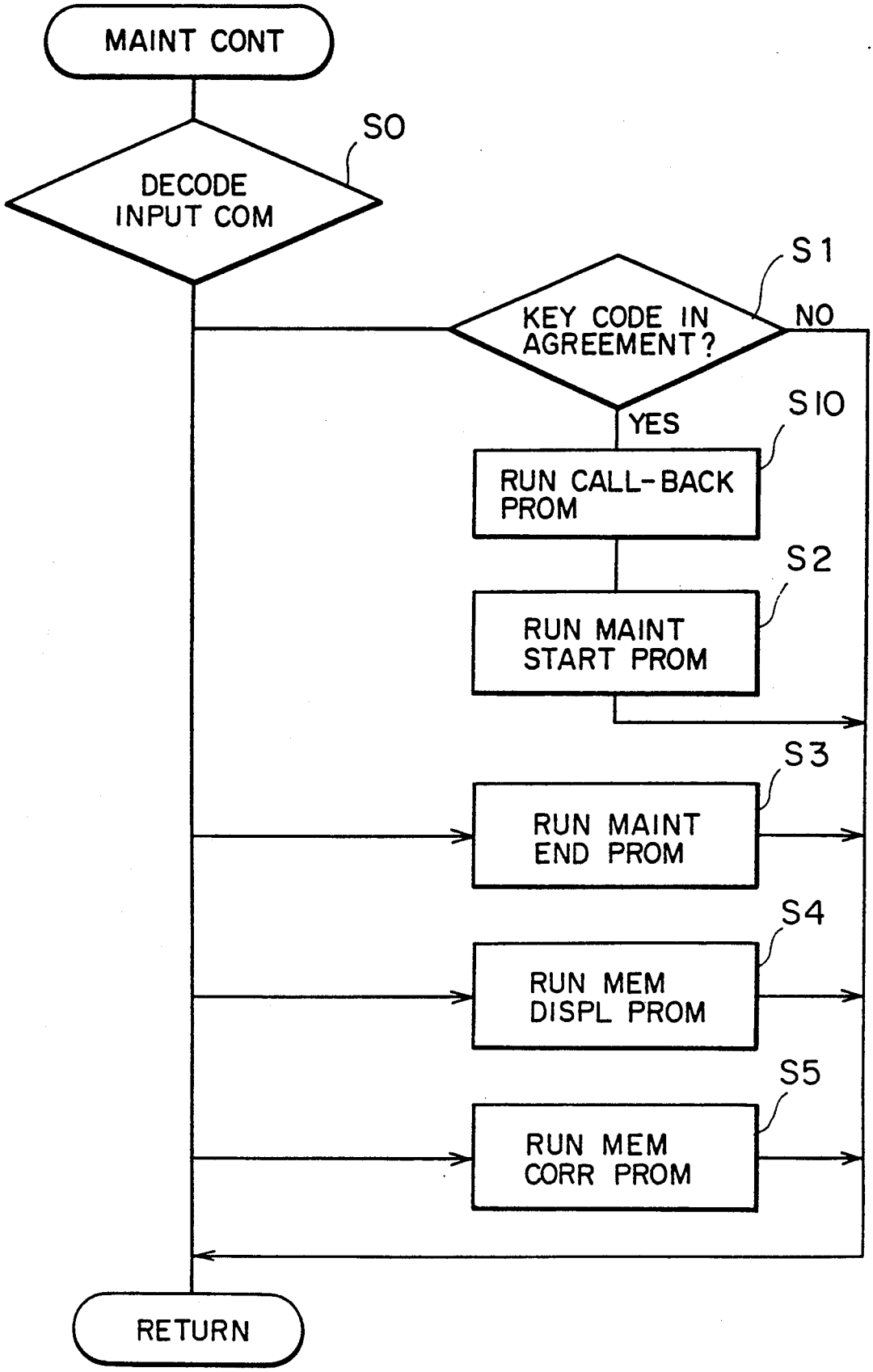
FIG. 1 is a flow chart showing an embodiment of this invention.
Figure 2:
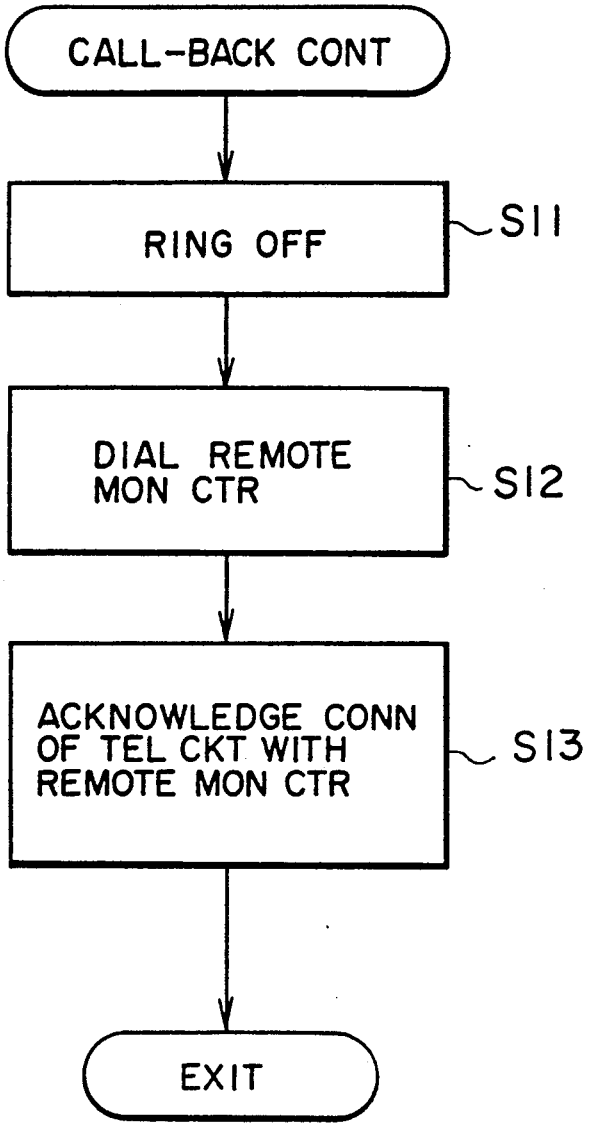
FIG. 2 is a flow chart showing a call-back program included in the embodiment of FIG. 1.
Figure 4:
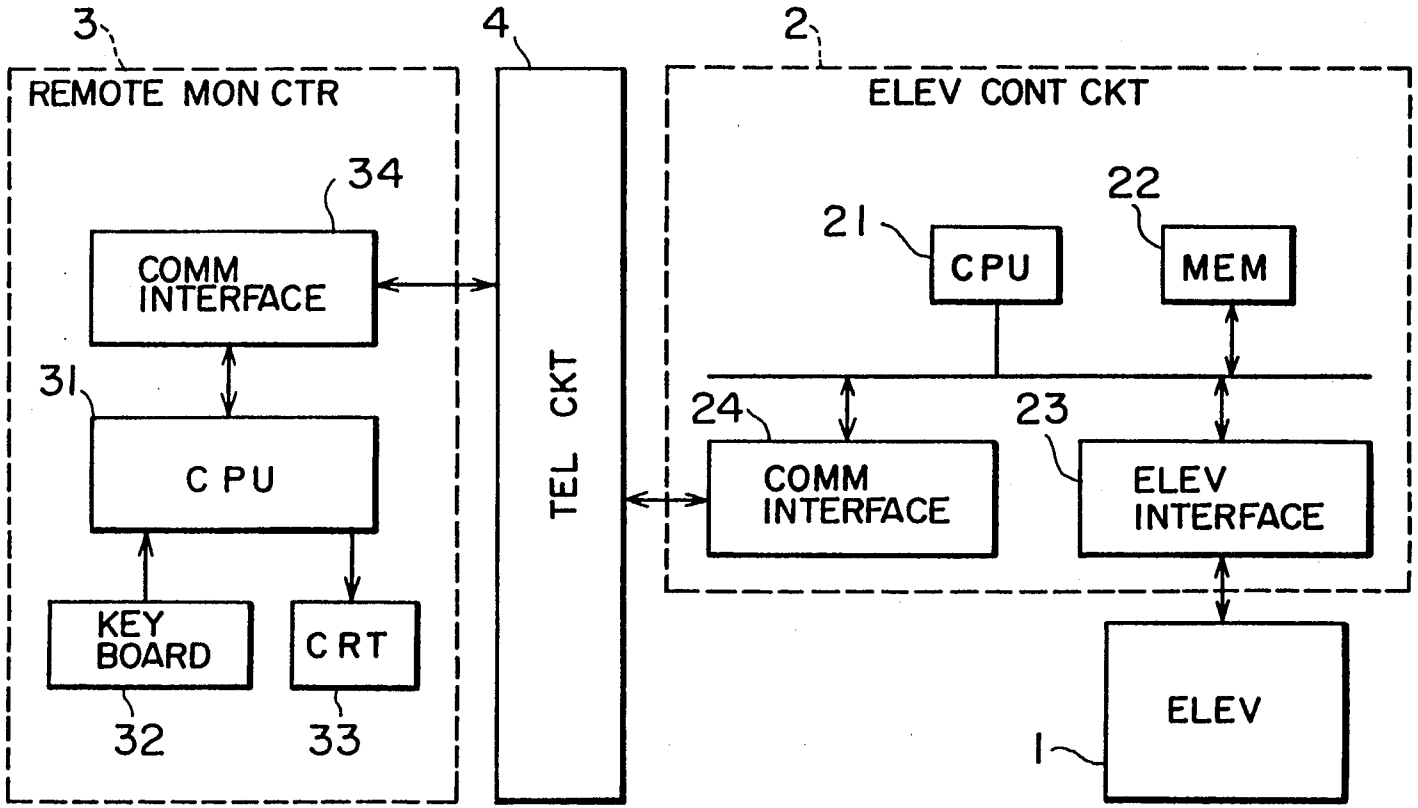
FIG. 4 PRIOR ART
FIG. 4 is a block diagram showing a conventional elevator control system.
Figure 5:
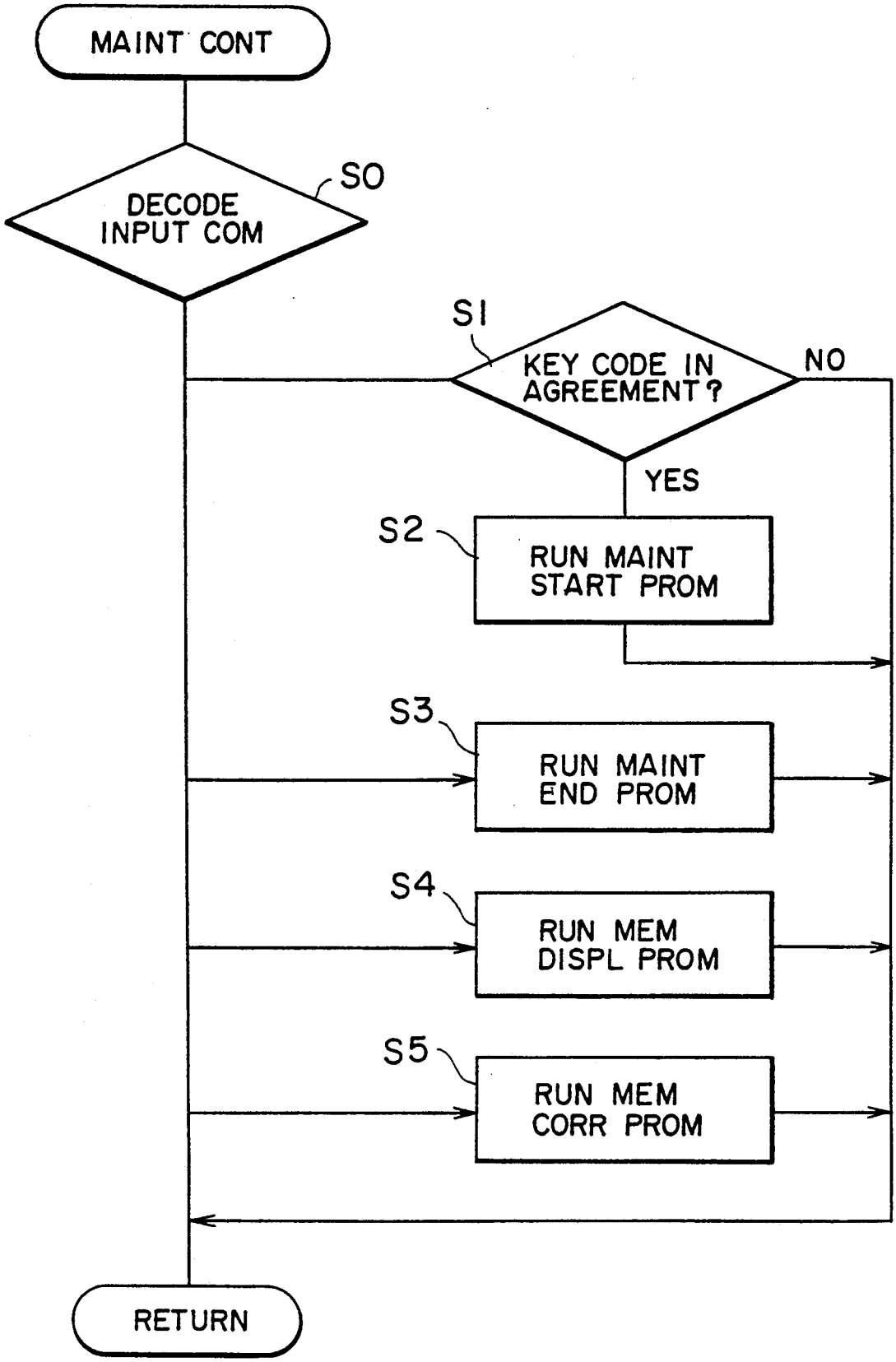
FIG. 5 PRIOR ART
FIG. 5 is a flow chart showing an elevator remote-control method in the prior art.

Now, an embodiment of this invention will be described with reference to the drawings. FIG. 1 is a flow chart showing one embodiment of this invention, while FIG. 2 is a flow chart showing a call back step in FIG. 1. Steps S0–S5 in FIG. 1 are the same as the foregoing steps S0–S5 in FIG. 5, respectively. Illustrated here is a case where, only when an input command is a maintenance start command, a call-back program is run. Incidentally, an elevator control system in which this invention is performed is as shown in FIG. 4, and programs which are held in the elevator control circuit 2 may be altered.

The CPU 21 in the elevator control circuit 2 decodes the input command (step S0), and subject to the maintenance start command, it decides if an input key code agrees with that of the elevator control circuit 2 (step S1).

If the key codes are in agreement, the CPU 21 immediately runs the call-back program (step S10) and thereafter runs the maintenance start program (step S2).

As shown in FIG. 2, the call-back program is constituted by the ring-off processing step S11 of once disconnecting the telephone circuit 4 when the maintenance command (here, the maintenance start command) has been received, the reconnection step S12 of dialing the remote monitoring center 3 to reconnect the telephone circuit 4, and the acknowledgement step S13 of acknowledging that the telephone circuit 4 has been connected between the elevator control circuit 2 and the remote monitoring center 3.

Accordingly, even when a maintenance command from a third party has been input to the elevator control circuit 2 by way of example, the telephone circuit 4 is cut off by the ring-off processing step S11. Therefore, even when the telephone circuit 4 between the elevator control circuit 2 and the remote monitoring center 3 has been subsequently reconnected (the reconnection step S12), the command from the third party is not input. As a result, the maintenance control program (S3–S5) conforming to the command from the third party is not run, and the programs or data items held in the elevator control circuit 2 are not unwillingly changed.

On the other hand, in the case where the maintenance start command from the remote monitoring center 3 has been input, the maintenance start program (the step S2) is run after the reconnection step S12 as well as the acknowledgement step S13. Accordingly, the whole maintenance command from the remote monitoring center 3 is subsequently input to the elevator control circuit 2, and the changes of the programs or data items, etc. are normally effected by the desired programs of the maintenance control program (S3–S5).

In the above embodiment, the call-back program (the step S10) has been inserted only before the maintenance start program (the step S2). In this regard, when all the programs of the maintenance control program (S2–S5) are preceded by the call-back programs (as run at the step S10), the intervention of the third party can be perfectly hindered.

During the maintenance control, however, the elevator control circuit 2 is performing an interrupt operation, and the elevator 1 is in a quiescent state or at an emergency stop in a specified floor. Also, the fees for telephone calls through the telephone circuit 4 during the maintenance control need to be taken into account. Thus, a shorter processing time expended on the maintenance control is better, and the call-back program should desirably be run for the minimum required maintenance command.

Figure 3:
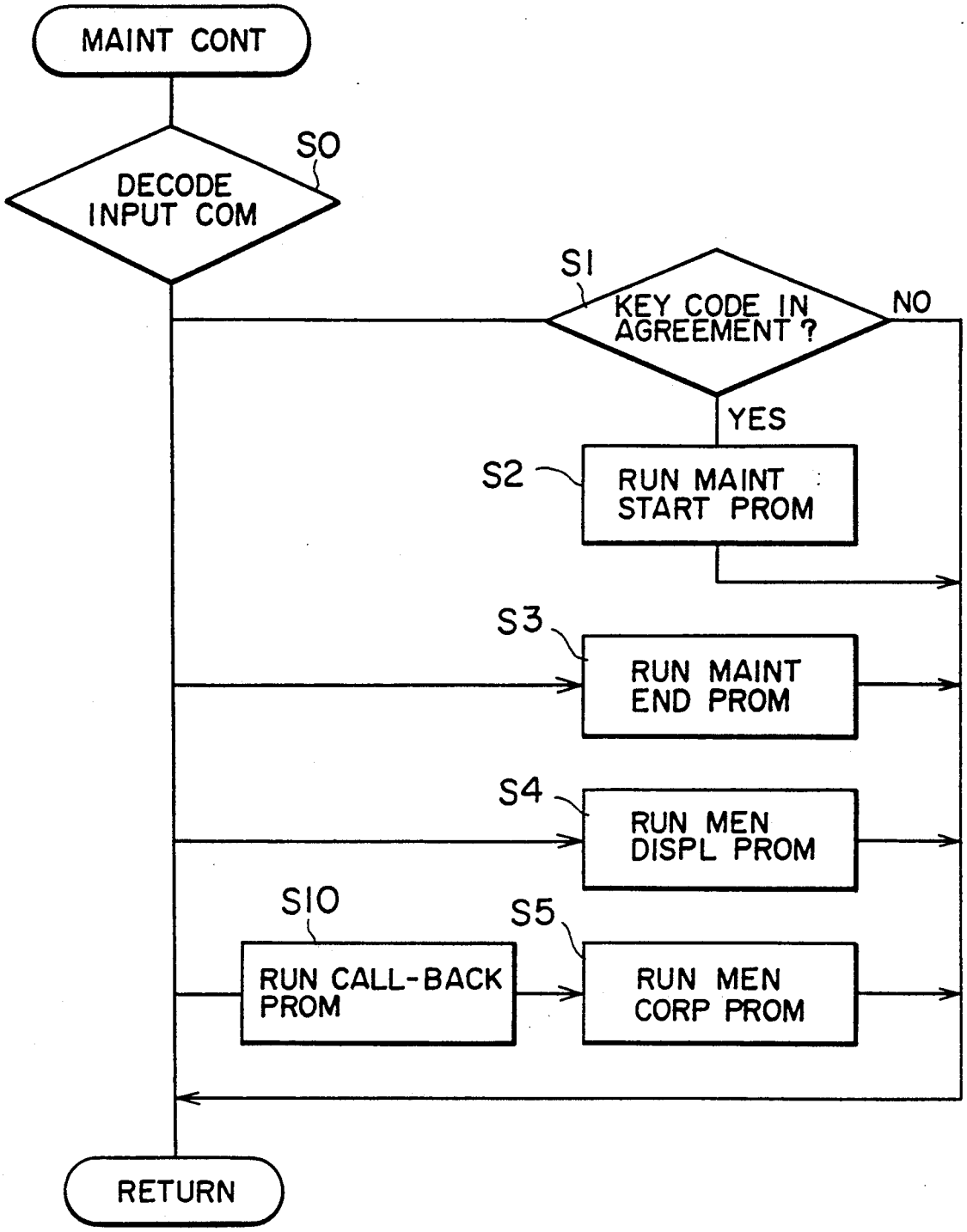
FIG. 3 is a flow chart showing another embodiment of this invention.

Accordingly, in a case where the memory display program (the step S4) which does not especially exert influence on the elevator control program is allowed to be run by the third party and where only program alterations and data alterations which exert influence on the elevator control program are to be prevented, the call-back program (the step S10) may be inserted before the memory correction program (the step S5) as shown in FIG. 3.

In this case, when the key code of the maintenance start command agrees (the step S1), the memory display program (the step S4) is permitted to be run, and only when the memory correction command has been input, the call back program (the step S10) is run. In comparison with those in the case of FIG. 1, therefore, the frequence in the run of the call-back program (the step S10) lowers, and the maintenance control processing time as the whole can be shortened.

Besides, the period of time for the processing based on the call-back program can be further shortened in such a way that the call-back program (the step S10) is inserted before the memory display program (the step S4) or the memory correction program (the step S5) and that the call back program is run depending upon the contents of the memory 22, namely, for only items which are to be particularly prevented from being read out or changed by the third party.

As described above, according to this invention, when a maintenance command has been received, a call-back program is run which comprises the ring-off processing step of once disconnecting a telephone circuit, and the reconnection step of dialing a remote monitoring center to reconnect the telephone circuit, and a program which conforms to the maintenance command is thereafter run, whereby the maintenance control program is prevented from being run in conformity with a command from a third party. Therefore, the invention brings forth the effect that the third party is hindered from intervening in an elevator control, so an elevator remote-control method of enhanced reliability is provided.

What is claimed is:

1. In an elevator remote-control method for an elevator control system having an elevator control circuit which controls a service situation of an elevator and which performs maintenance control for the elevator, and a remote monitoring center which is connected to the elevator control circuit through a telephone circuit and which monitors the service situation of the elevator, wherein when the elevator control circuit has received a maintenance command for maintenance control from the remote monitoring center, said control circuit performs maintenance control of the elevator and executes a maintenance control program stored therein;

an elevator remote-control method comprising, when said elevator control circuit has received said maintenance command, executing a call-back program which comprises a ring-off processing step of disconnecting said telephone circuit, and a reconnection step of dialing said remote monitoring center to reconnect said telephone circuit, whereupon said control circuit executes any program of the maintenance control program conforming to the maintenance command.

2. An elevator remote-control method as defined in claim 1, wherein said maintenance command is a maintenance start command, and said elevator control circuit runs a maintenance start program after said call-back program.

3. An elevator remote-control method as defined in claim 1, wherein said maintenance command is a memory correction command, and said elevator control circuit runs a memory correction program for altering content of a memory included therein, after said call-back program.

4. An elevator remote-control method as defined in claim 1, wherein said maintenance command is either a memory display command or a memory correction command, and said elevator control circuit runs said call-back program as to only that content of a memory included therein which is neither to be read out nor to be altered by a third party.

* * * * *